US008705990B2

(12) United States Patent
Pines et al.

(10) Patent No.: US 8,705,990 B2
(45) Date of Patent: Apr. 22, 2014

(54) IDENTIFICATION OF A FIRST AND SECOND ADJUSTMENT VALUE BASED ON A FIRST AND SECOND ELECTRICAL DISCHARGE EVENT

(75) Inventors: Assaf Pines, Rehovot (IL); Gadi Oron, Rehovot (IL); Amir Ofir, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 152 days.

(21) Appl. No.: 13/530,340

(22) Filed: Jun. 22, 2012

(65) Prior Publication Data

US 2013/0343771 A1 Dec. 26, 2013

(51) Int. Cl.
*G03G 15/02* (2006.01)

(52) U.S. Cl.
USPC ..... 399/31; 399/50; 399/176

(58) Field of Classification Search
USPC ..... 399/31, 50, 174–176
See application file for complete search history.

(56) References Cited

U.S. PATENT DOCUMENTS 7,835,668 B2 * 11/2010 Lee et al. ..... 399/176
2009/0116879 A1 5/2009 Nedelin

* cited by examiner

*Primary Examiner* — Hoang Ngo

(57) ABSTRACT

A method includes moving a first end portion of a charging member with respect to a photoconductive member to obtain a first electrical discharge event corresponding to conduction of an electrical current from the charging member to the photoconductive member. The method also includes identifying a first adjustment value corresponding to a distance in which the first end portion moved toward the photoconductive member to obtain the first electrical discharge event. The method also includes moving a second end portion of the charging member with respect to the photoconductive member to obtain a second electrical discharge event corresponding to conduction of an electrical current from the charging member to the photoconductive member. The method also includes identifying a second adjustment value corresponding to a distance in which the second end portion moved toward the photoconductive member to obtain the second electrical discharge event.

20 Claims, 9 Drawing Sheets

IDENTIFICATION OF A FIRST AND SECOND ADJUSTMENT VALUE BASED ON A FIRST AND SECOND ELECTRICAL DISCHARGE EVENT

BACKGROUND

Imaging forming systems such as liquid electrophotography printing systems include a charging member to charge an outer surface of a photoconductive member, an imaging member to selectively change the charge on portions of the outer surface of the photoconductive member to form a latent image thereon. A fluid applicator unit may provide fluid such as charged liquid toner to the latent image on the outer surface of the photoconductive member to form an image.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
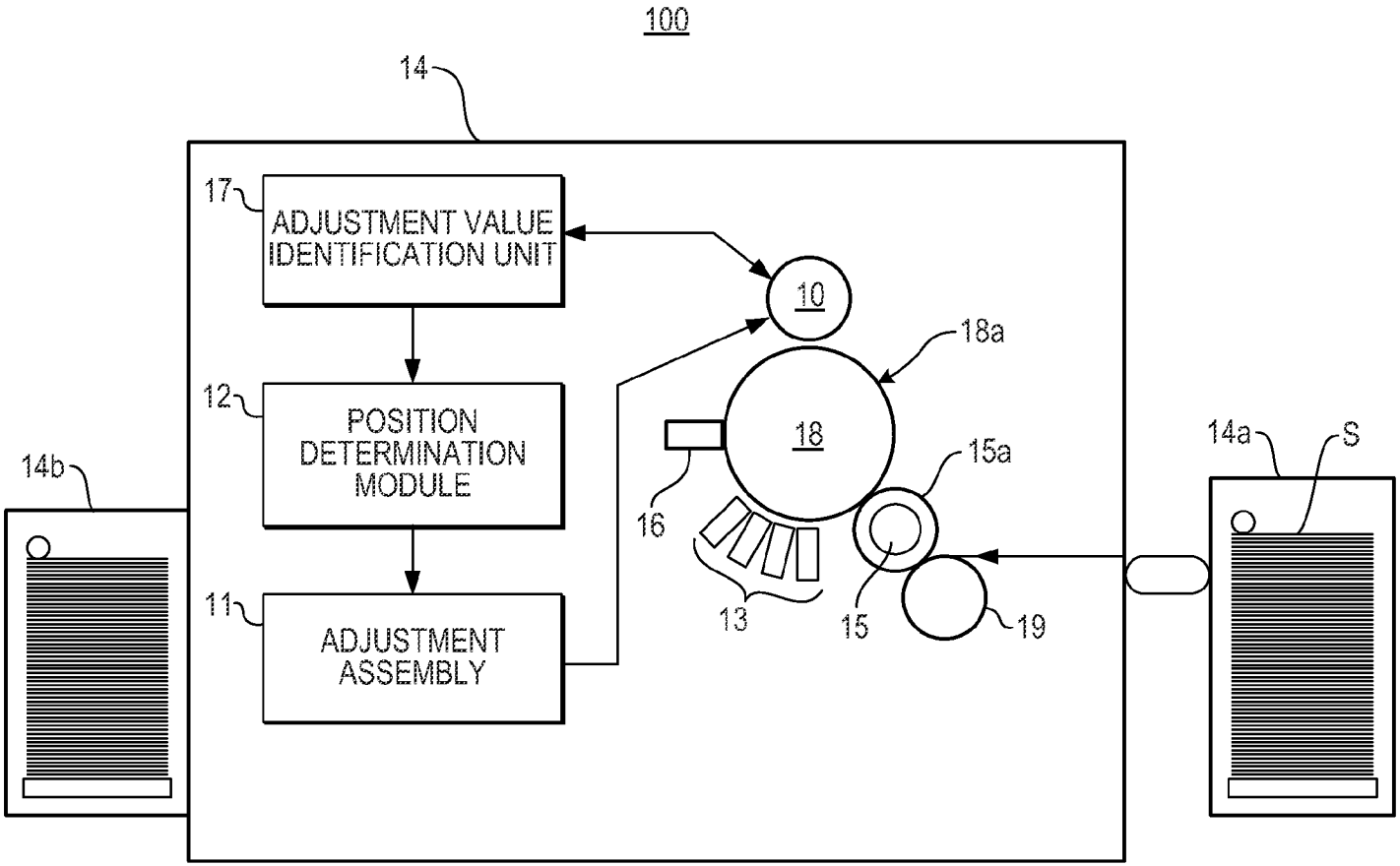
FIG. 1 is a schematic view illustrating an image forming system such as a liquid electrophotography printing system according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Imaging forming systems such as liquid electrophotography printing systems include a charging member such as a charge roller disposed proximate to the photoconductive member to charge an outer surface of a photoconductive member, an imaging member to change the charge on selected portions of the outer surface to form a latent image thereon. That is, the imaging member may increase or decrease an amount of charge on selected portions of the outer surface of the photoconductive member to form a latent image thereon. A fluid applicator unit may apply fluid such as charged liquid toner to the latent image on the outer surface of the photoconductive member to form an image thereon. However, the distance between the charging member and the photoconductive member may change over time due to a change in the size of the charging member, for example, due to fluid absorption and/or a change in the size between a previously-used charging member and a replacement charging member. Such changes in size of the charging member may unintentionally vary the distance between the charging member and the photoconductive member. Thus, the effectiveness of the charging of the outer surface of the photoconductive member and/or the lifespan of the charging member due to unwanted liquid absorption from the photoconductive member to the charging member may be decreased.

In examples, a method of calibrating an orientation of a charging member with respect to a photoconductive member in an image forming system includes moving a first end portion of a charging member with respect to a photoconductive member and identifying a first adjustment value corresponding to a distance in which the first end portion moved toward the photoconductive member to obtain the first electrical discharge event. The method also includes moving a second end portion of the charging member with respect to the photoconductive member and identifying a second adjustment value corresponding to a distance in which the second end portion moved toward the photoconductive member to obtain the second electrical discharge event. The method may also include determining a first distance to move the first end portion and a second distance to move the second end portion based on the first adjustment value and the second adjustment value to place the charging member in a substantially parallel position with respect to the photoconductive member. Accordingly, changes in size of the charging member may be compensated for by adjusting the distance between the charging member and the photoconductive member to maintain the effectiveness of the charging of the outer surface of the photoconductive member and/or the lifespan of the charging member by reducing unwanted liquid absorption from the photoconductive member to the charging member.

FIG. 1 is a schematic view illustrating an image forming system such as a liquid electrophotography printing system (LEP) according to an example. Referring to FIG. 1, an image forming system 100 such as an LEP includes an image forming assembly 14 that receives substrate S from an input unit 14*a* and outputs the substrate S to an output unit 14*b*. The image forming assembly 14 includes a fluid applicator unit 13 and a photoconductive member 18 on which images can be formed. The photoconductive member 18 may include an outer surface 18*a* to be charged with a charging member 10 such as a charge roller, and the like. The charge of selected portions of the outer surface 18*a* of the photoconductive member 18 that correspond to features of the image can be selectively changed by an imaging member 16 such as a laser writing unit, and the like, to form a latent image thereon. That is, the imaging member may increase or decrease an amount of charge on selected portions of the outer surface of the photoconductive member to form a latent image thereon.

Referring to FIG. 1, in some examples, the image forming system 100 may include an adjustment assembly 11, an adjustment value identification unit 17, and a position determination module 12. The adjustment assembly 11 may move a first end portion of the charging member 10 toward the photoconductive member 18 to obtain a first electrical discharge event and to move a second end portion of the charging member 10 toward the photoconductive member 18 to obtain a second electrical discharge event. The adjustment assembly 11 may communicate with the position determination unit 12 and monitor the charging member 10. The first electrical discharge event may correspond to conduction of electrical current from the first end portion of the charging member 10 to the photoconductive member 18. The second electrical discharge event may correspond to conduction of electrical current from the second end portion of the charging member 10 to the photoconductive member 18. Conduction of electrical current between the charging member 10 and the photoconductive member 18 may occur at a breakdown distance.

The adjustment value identification module 17 may identify a first adjustment value corresponding to a distance the first end portion moved toward the photoconductive member 18 to obtain the first electrical discharge event. The adjustment value identification module 17 may also identify a second adjustment value based on a distance the second end portion moved toward the photoconductive member 18 to obtain the second electrical discharge event. In some examples, the adjustment value identification module 17 may monitor the charging member 10 and communicate with the position determination module 12. The position determination module 12 may determine a set orientation position by determining a first distance and a second distance based on the first adjustment value and the second adjustment value. The adjustment assembly 11 may adjust an orientation of the charging member 10 with respect to the photoconductive member 18 to the set orientation position.

Referring to FIG. 1, in some examples, the fluid applicator unit 13 such as binary ink developers may apply the fluid such as liquid toner to the latent image on the outer surface 18*a* of the photoconductive member 18 to form an image to be transferred to an intermediate transfer member (ITM) 15 that may include a blanket 15*a* thereon. Subsequently, the ITM 15 may transfer the image to the substrate S. During the transfer of the image from the blanket 15*a* of the ITM 15 to the substrate S, the substrate S may be pinched between the ITM 15 and an impression member 19. Once the image has been transferred to the substrate S, the substrate S may be transported to the output unit 14*b*.

Figure 2:
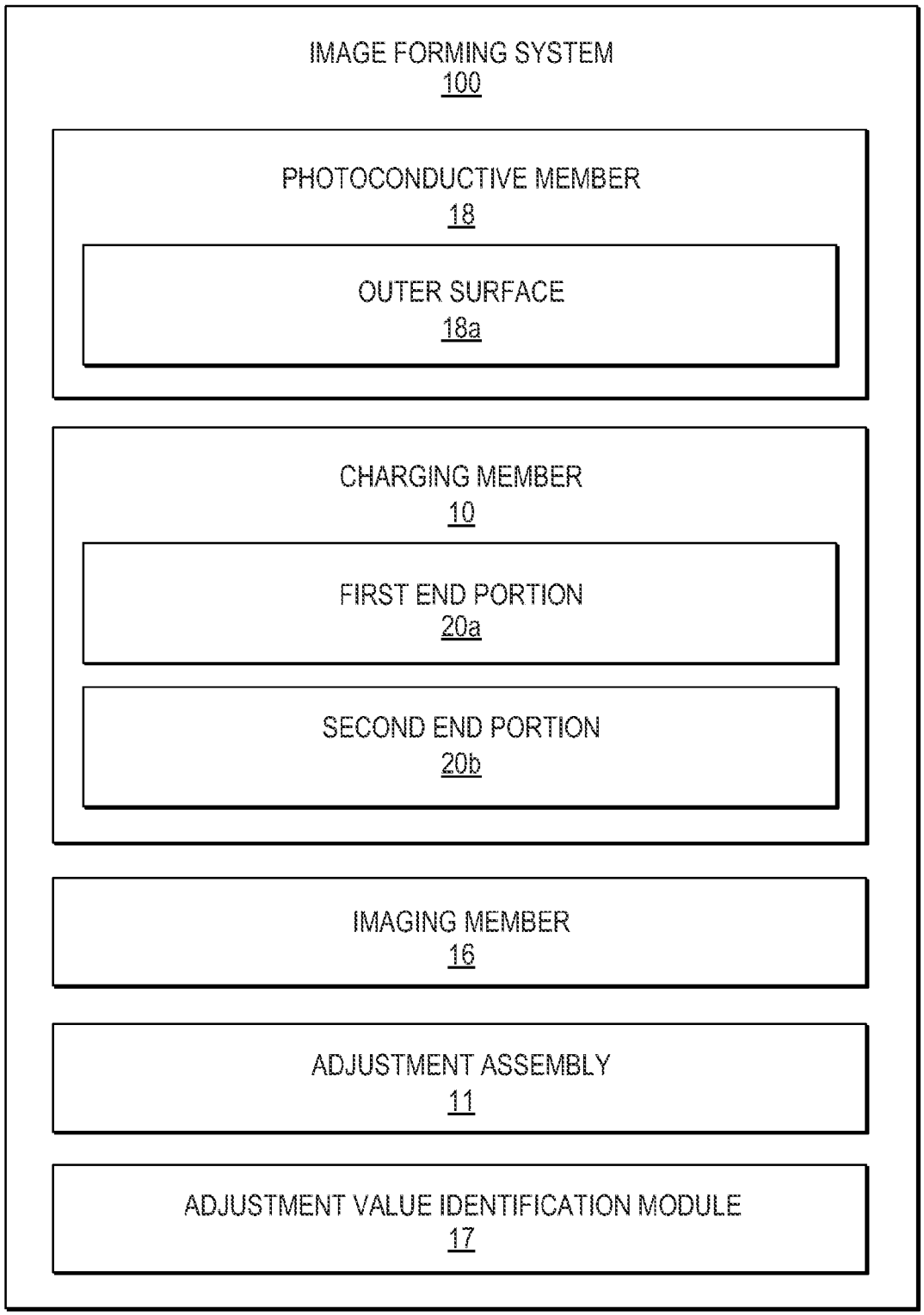
FIG. 2 is a block diagram illustrating an image forming system according to an example.

FIG. 2 is a block diagram illustrating an image forming system according to an example. Referring to FIG. 2, in some examples, an image forming system 200 includes a photoconductive member 18, a charging member 10, an imaging member 16, an adjustment assembly 11, and an adjustment value identification module 17. The photoconductive member 18 may include an outer surface 18*a* to form a latent image thereon. In some examples, the photoconductive member 18 may include a photo imaging cylinder. The charging member 10 may include a first end portion 20*a* and a second end portion 20*b*. In some examples, the charging member 10 may include a charge roller. The charging member 10 may charge the outer surface 18*a* of the photoconductive member 18 and be proximate to the photoconductive member 18.

The imaging member 16 may change the charge of selected portions of the outer surface 18*a* of the photoconductive member 18 to form the latent image thereon. That is, the imaging member may increase or decrease an amount of charge on selected portions of the outer surface of the photoconductive member to form a latent image thereon. In some examples, the image forming system 200 may also include a fluid applicator unit 13 and an intermediate transfer member 15 as previously disclosed with respect to the image forming system 100 illustrated in FIG. 1. The fluid applicator unit 13 may apply fluid to the latent image on the outer surface 18*a* of the photoconductive member 18 to form an image. The intermediate transfer member 15 may receive the image from the photoconductive member 18 and transfer the image to a substrate S.

The adjustment assembly 11 may move the first end portion 20*a* of the charging member 10 toward the photoconductive member 18 to obtain a first electrical discharge event. The adjustment assembly 11 may also move the second end portion 20*b* of the charging member 10 toward the photoconductive member 18 to obtain a second electrical discharge event. The adjustment value identification module 17 may identify a first adjustment value corresponding to a distance the first end portion 20*a* moved toward the photoconductive member 18 to obtain the first electrical discharge event. The adjustment value identification module 17 may also identify a second adjustment value based on a distance the second end portion 20*b* moved toward the photoconductive member 18 to obtain the second electrical discharge event.

Figure 3A:
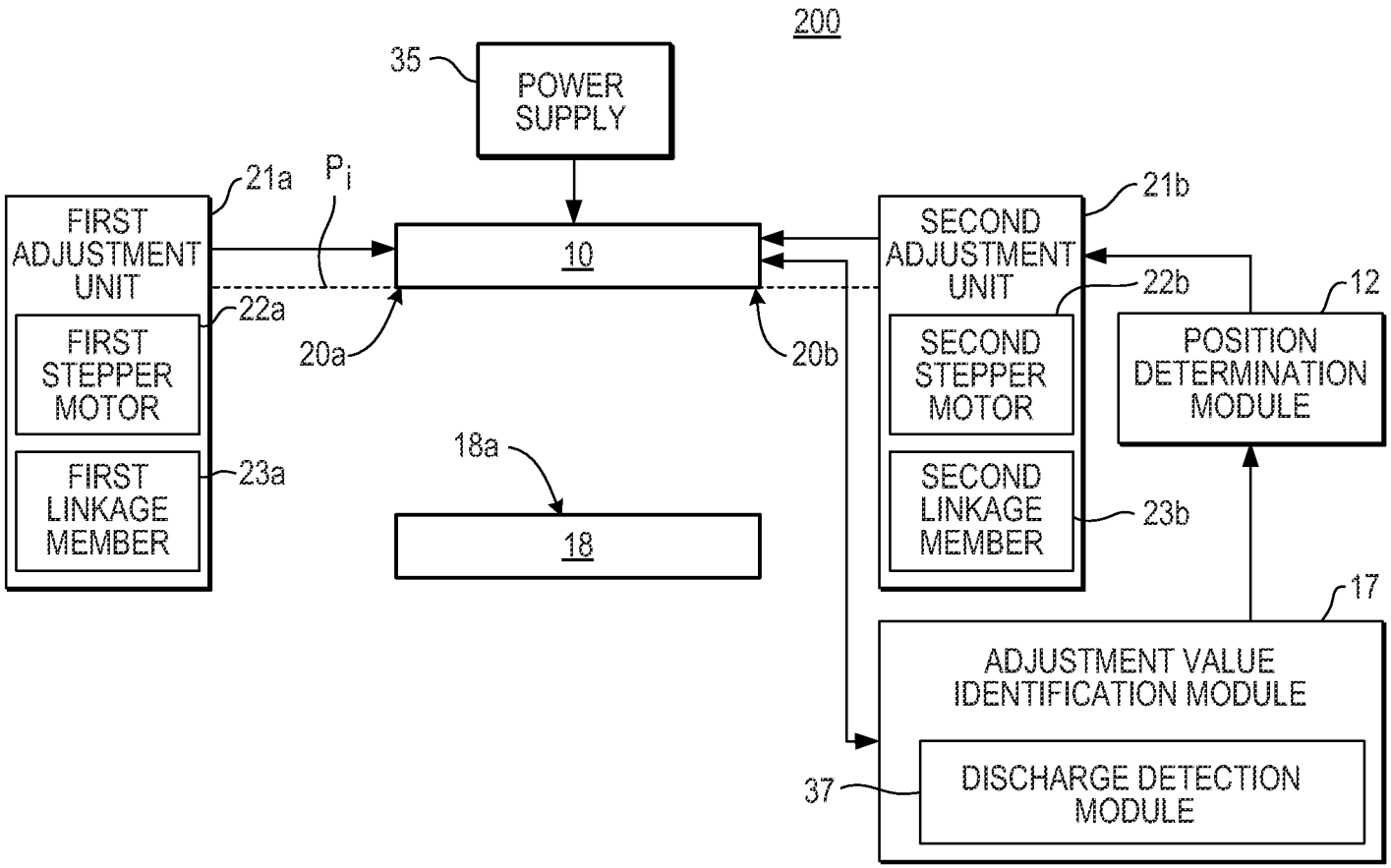
FIG. 3A is a schematic view illustrating the image forming system of FIG. 2 including a charging member placed in an initial position with respect to a photoconductive member according to an example.
Figure 3B:
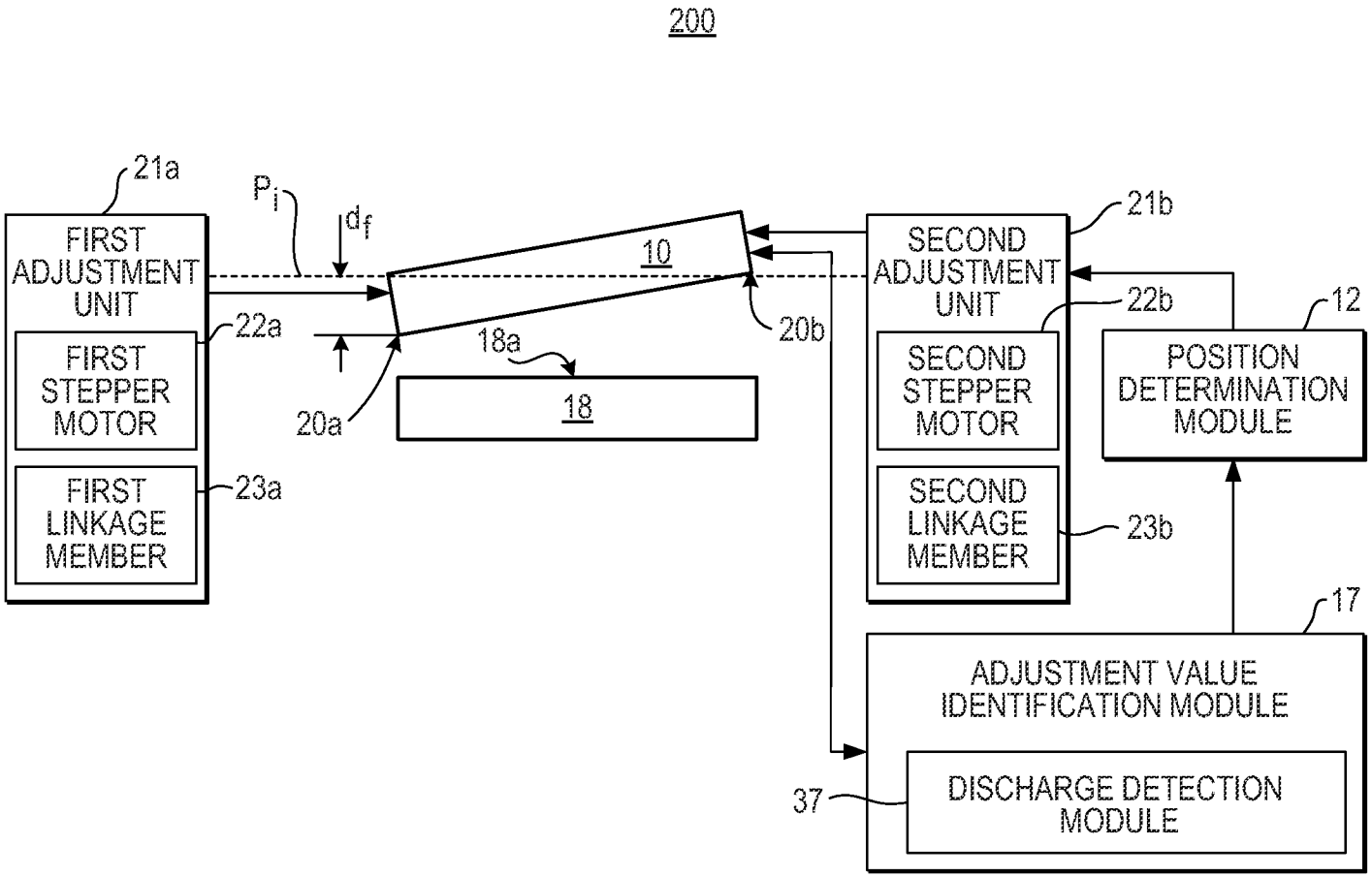
FIG. 3B is a schematic view illustrating the image forming system of FIG. 2 including a first end portion of the charging member placed in a breakdown position with respect to the photoconductive member according to an example.
Figure 3C:
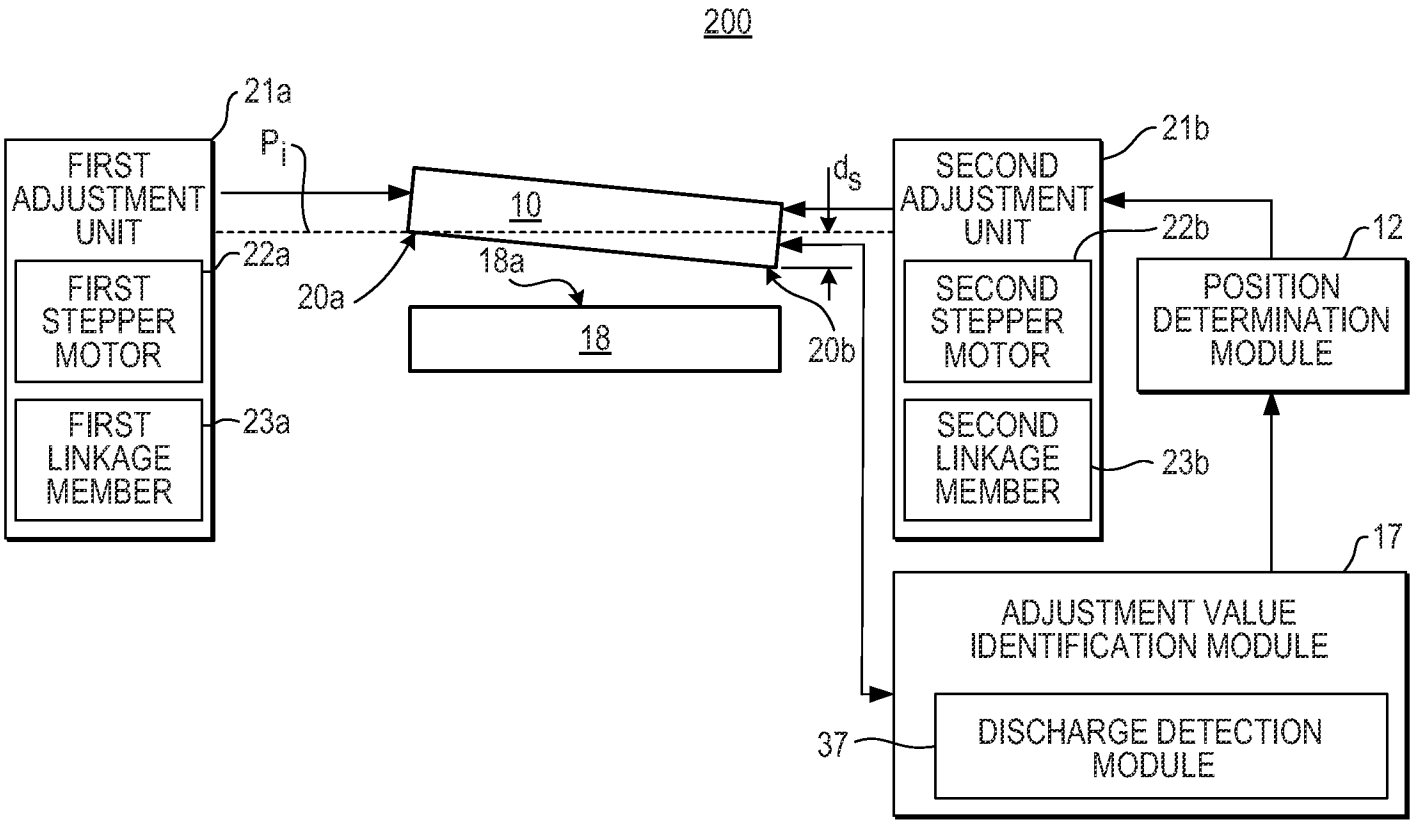
FIG. 3C is a schematic view illustrating the image forming system of FIG. 2 including a second end portion of the charging member placed in a breakdown position with respect to the photoconductive member according to an example.
Figure 3D:
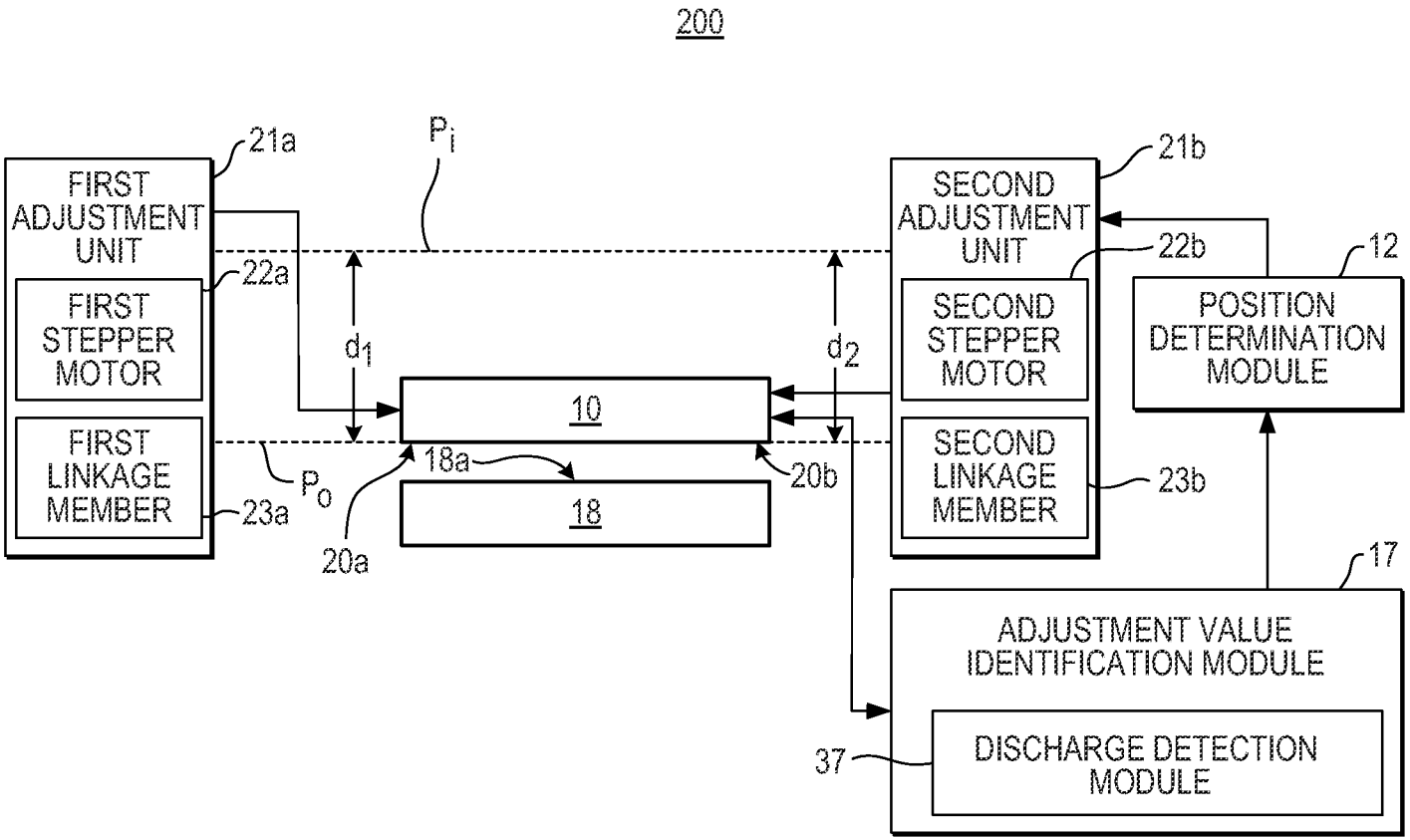
FIG. 3D is a schematic view illustrating the image forming system of FIG. 2 including the charging member in a set orientation position with respect to the photoconductive member according to an example.
Figure 4:
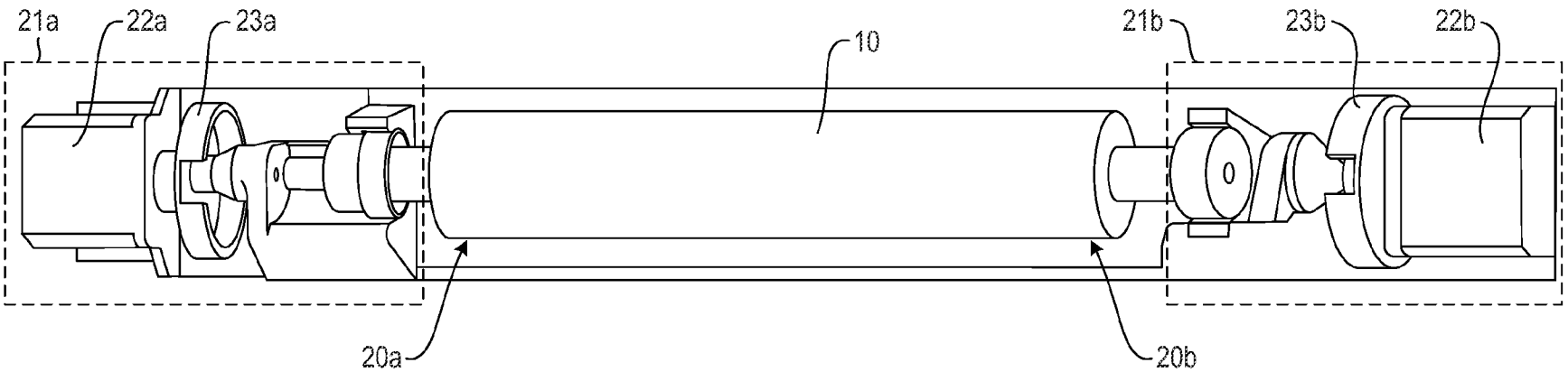
FIG. 4 is a perspective view illustrating the charging member and respective adjustment units of the image forming system of FIG. 2 according to an example.

FIG. 3A is a schematic view illustrating the image forming system of FIG. 2 including a charging member placed in an initial position with respect to a photoconductive member according to an example. FIG. 3B is a schematic view illustrating the image forming system of FIG. 2 including a first end portion of the charging member placed in a breakdown position with respect to the photoconductive member according to an example. FIG. 3C is a schematic view illustrating the image forming system of FIG. 2 including a second end portion of the charging member placed in a breakdown position with respect to the photoconductive member according to an example. FIG. 3D is a schematic view illustrating the image forming system of FIG. 2 including the charging member in a set orientation position with respect to the photoconductive member according to an example. FIG. 4 is a perspective view illustrating the charging member and respective adjustment units of the image forming system of FIG. 2 according to an example. Referring to FIGS. 3A-4, in some examples, an image forming system 200 includes a photoconductive member 18, a charging member 10, an imaging member 16, an adjustment assembly 21*a* and 21*b* (collectively 11), and an adjustment value identification module 17 as previously disclosed with respect to FIGS. 1 and 2. In some examples, the adjustment assembly 11 may include a first adjustment unit 21*a* and a second adjustment unit 21*b*. As illustrated in FIG. 3A, the charging member 10 is placed in an initial position $P_i$. For example, a power supply 35 may charge the charging member 10 when the charging member 10 is placed in the initial position $P_i$.

Referring to FIGS. 3B and 4, in some examples, the first adjustment unit 21*a* may include a first stepper motor 22*a* and at least one first linkage member 23*a* coupling the first stepper motor 22*a* to the charging member 10 to move the first end portion 20*a* of the charging member 10 toward and away from the photoconductive member 18. In some examples, the at least one first linkage member 23*a* may include a first cam. Thus, the first end portion 20*a* may be moved by a number of steps of the first stepper motor 22*a*. The first adjustment value may correspond to a number of steps moved by the first stepper motor 22*a* based on a distance $d_s$ the first end portion 20*a* moved toward the photoconductive member 18 to obtain the first electrical discharge event. The adjustment value identification unit 17 may also include a discharge detection module 37 to detect a first and second electrical discharge event.

That is, the discharge detection module 37 may detect conduction of an electrical current from the charging member 10 to the photoconductive member 18. For example, the discharge detection module 37 may monitor at least one of the charging member 10, the power supply 35, the photoconductive member 18, and the like, to detect conduction of the electrical current from the charging member 10 to the photoconductive member 18. Thus, in some examples, the first adjustment value may equal the number of steps the first stepper motor 22*a* moved the first end portion 20*a* from the initial position $P_i$ to the position when the first electrical discharge event was detected by the discharge detection module 37 (e.g., breakdown position). Subsequently, the first adjustment unit 21*a* may move the first end portion 20*a* away from the photoconductive member 18, for example, to an initial position $P_i$ in response to the first electrical discharge event. For example, in a respective initial position $P_i$, a first electrical discharge event does not occur.

Referring to FIGS. 3C and 4, in some examples, the second adjustment unit 21*b* may include a second stepper motor 22*b* and at least one second linkage member 23*b* coupling the second stepper motor 22*b* to the charging member 10 to move the second end portion 20*b* of the charging member 10 toward and away from the photoconductive member 18. In some examples, the at least one second linkage member 23*b* may include a second cam. Thus, the second end portion 20*b* may be moved by a number of steps of the second stepper motor 22*b*. The second adjustment value may correspond to a number of steps moved by the second stepper motor 22*b* based on a distance $d_s$ the second end portion 20*b* moved toward the photoconductive member 18 to obtain the second electrical discharge event. Thus, in some examples, the second adjustment value may equal the number of steps the second stepper motor 22*b* moved the second end portion 20*b* from the initial position $P_i$ to the position when the second electrical discharge event was detected by the discharge detection module 37 (e.g., breakdown position). Subsequently, the second adjustment unit 21*b* may move the second end portion 20*b* away from the photoconductive member 18, for example, to an initial position $P_i$ in response to the second electrical discharge event. For example, in a respective initial position a second electrical discharge event does not occur.

Referring to FIG. 3D, in some examples, the position determination module 12 may determine a set orientation position $P_o$ by determining a first distance $_{d1}$ and a second distance $d_2$ based on the first adjustment value and the second adjustment value. The set orientation position $p_o$ may include an orientation of the charging member 10 substantially parallel to the photoconductive member 18. The adjustment assembly 11 may adjust an orientation of the charging member 10 with respect to the photoconductive member 18 to the set orientation position $p_o$ by moving the first end portion 20*a* towards the photoconductive member 18 by the first distance $d_1$ and moving the second end portion 20*b* towards the photoconductive member 18 by the second distance $d_2$. For purposes of illustration, in an example, the first adjustment value may correspond to be twenty-five steps of the first stepper motor 22*a* and the second adjustment value may correspond to be twenty steps of the second stepper motor 22*b*. Thus, the first distance $f_1$ may be determined to correspond to moving twenty-five steps of the first stepper motor 22*a* plus an additional number of steps corresponding to a constant supplemental distance. The second distance $f_2$ may be determined to correspond to moving twenty steps of the second stepper motor 22*b* plus an additional number of steps corresponding to the constant supplemental distance. That is, moving the first end portion 20*a* and the second end portion 20*b* of the charging member 10 by twenty-five and twenty steps from the initial position $p_i$, respectively, may orient the charging member 10 substantially parallel with the photoconductive member 18. Further, moving both end portions 20*a* and 20*b* of the charging member 10 by the constant supplemental distance may place the charging member 10 in an intended position while maintaining the charging member 10 parallel to the photoconductive member 18.

In some examples, the adjustment value identification module 17, discharge detection module 37, and the position determination module 12 may be implemented in hardware, software including firmware, or combinations thereof. The firmware, for example, may be stored in memory and executed by a suitable instruction-execution system. If implemented in hardware, as in an alternative example, the adjustment value identification module 17, discharge detection module 37, and the position determination module 12 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the adjustment value identification module 17, discharge detection module 37, and the position determination module 12 may be implemented in a combination of software and data executed and stored under the control of a computing device.

Figure 5:
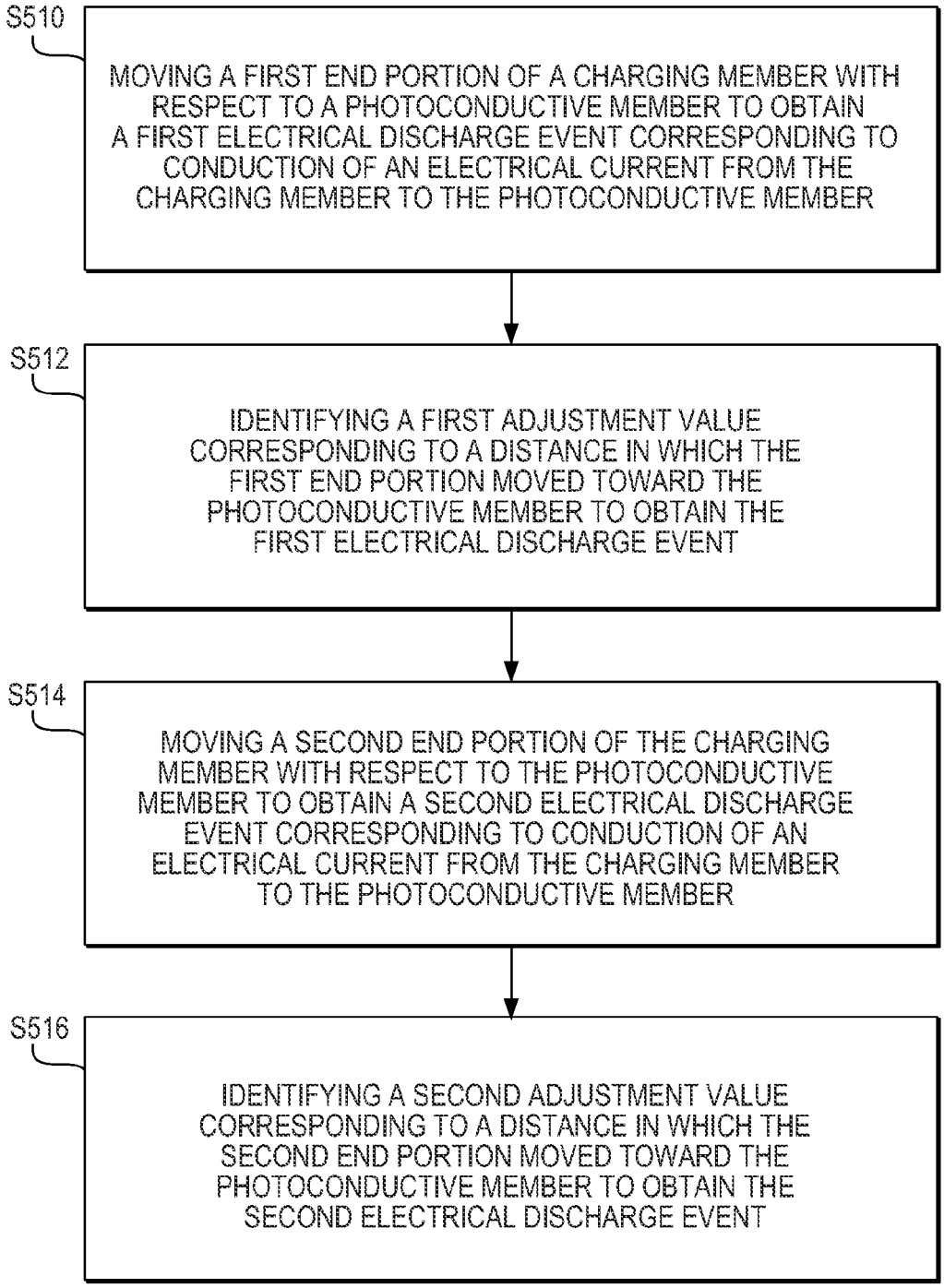
FIG. 5 is a flowchart illustrating a method of calibrating an orientation of a charging member with respect to a photoconductive member in an image forming system according to an example.

FIG. 5 is a flowchart illustrating a method of calibrating an orientation of a charging member with respect to a photoconductive member in an image forming system according to an example. Referring to FIG. 5, in block S510, a first end portion of a charging member is moved with respect to a photoconductive member to obtain a first electrical discharge event corresponding to conduction of an electrical current from the charging member to the photoconductive member. For example, the first end portion may be moved by a first adjustment unit. In block S512, a first adjustment value is identified corresponding to a distance in which the first end portion moved toward the photoconductive member to obtain the first electrical discharge event. For example, the first adjustment value may be identified by an adjusted value identification module 17. In some examples, the first adjustment value may correspond to a number of steps moved by a first stepper motor based on the distance the first end portion moved toward the photoconductive member to obtain the first electrical discharge event.

Referring to FIG. 5, in block S514, a second end portion of the charging member is moved with respect to the photoconductive member to obtain a second electrical discharge event corresponding to conduction of an electrical current from the charging member to the photoconductive member. For example, the second end portion may be moved by a second adjustment unit. In block S516, a second adjustment value is identified corresponding to a distance in which the second end portion moved toward the photoconductive member to obtain the second electrical discharge event. For example, the second adjustment value may be identified by an adjusted value identification module 17. In some examples, the second adjustment value may correspond to a number of steps moved by a second stepper motor based on the distance the second end portion moved toward the photoconductive member to obtain the second electrical discharge event.

In some examples, the method may also include determining a first distance to move the first end portion and a second distance to move the second end portion based on the first adjustment value and the second adjustment value to place the charging member in a substantially parallel position with respect to the photoconductive member. For example, a number of steps to be moved by a first stepper motor to move the first end portion may be determined and a number of steps to be moved by a second stepper motor to move the second end portion may be determined to place the charging member in the set orientation position. In some examples, an offset value may be calculated based on a difference between the first adjustment value and the second adjustment value. Additionally, the offset value may be applied to determine at least one of the first distance to move the first end portion and the second distance to move the second end portion.

In some examples, the method may also include charging the charging member by a power supply in response to the charging member being placed in an initial position prior to the moving the first end portion of the charging member with respect to the photoconductive member to obtain the first electrical discharge event. The method may also include moving the first end portion by the first distance and the second end portion by the second distance to place the charging member in a substantially parallel position with respect to the photoconductive member. The method may also include moving the first end portion of the charging member away from the photoconductive member to an initial position in response to the first electrical discharge event and moving the second end portion of the charging member away from the photoconductive member to an initial position in response to the second electrical discharge event. In some examples, the charging member may include a charge roller and the photoconductive member may include a photo imaging cylinder.

Figure 6:
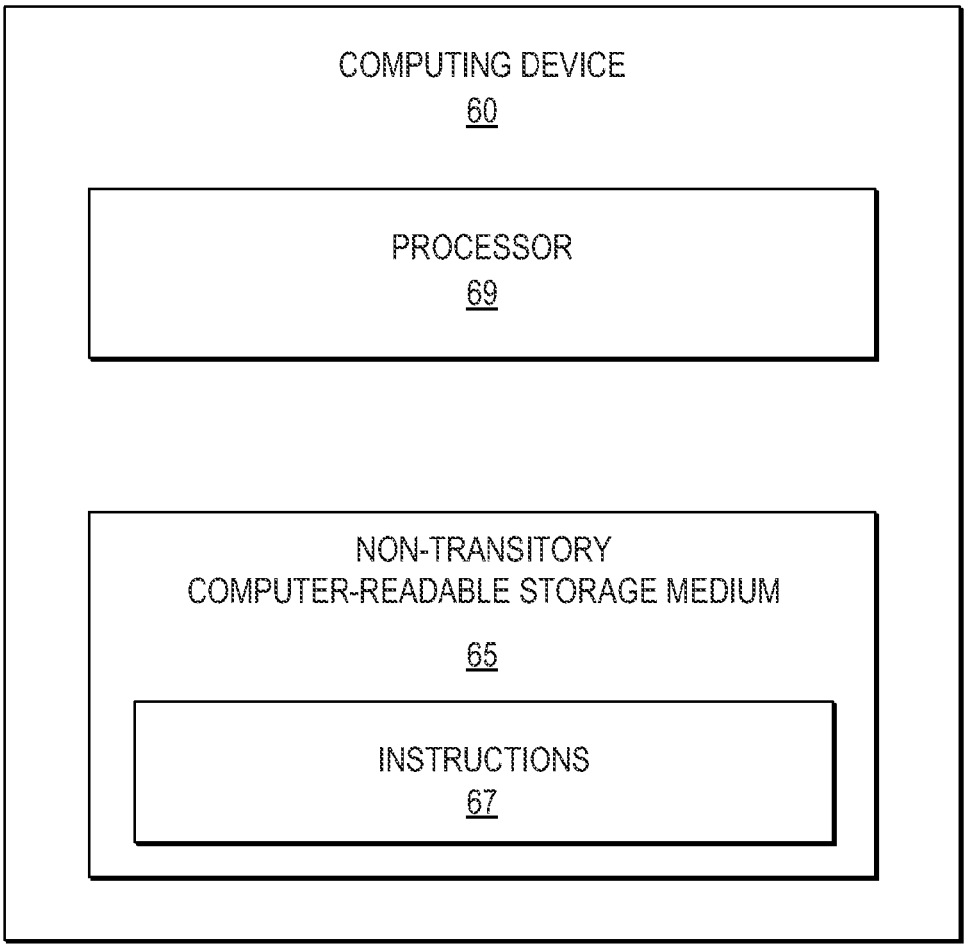
FIG. 6 is a block diagram illustrating a computing device such as an image forming system including a processor and a non-transitory, computer-readable storage medium to store instructions to operate the computing device to calibrate an orientation of a charging member with respect to a photoconductive member according to an example.

FIG. 6 is a block diagram illustrating a computing device such as an image forming system including a processor and a non-transitory, computer-readable storage medium to store instructions to operate the computing device to calibrate an orientation of a charging member with respect to a photoconductive member according to an example. Referring to FIG. 6, in some examples, the non-transitory, computer-readable storage medium 65 may be included in a computing device 60 such as an image forming system 100 and 200. In some examples, the non-transitory, computer-readable storage medium 65 may be implemented in whole or in part as computer-implemented instructions stored in the image forming system 100 and 200 locally or remotely, for example, in a server or a host computing device considered herein to be part of the image forming system 100 and 200.

Referring to FIG. 6, in some examples, the non-transitory, computer-readable storage medium 65 may correspond to a storage device that stores computer-implemented instructions, such as programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 60 such as an image forming system 100 and 200 to calibrate an orientation of a charging member with respect to a photoconductive member in accordance with an example. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming system, comprising:

a photoconductive member having an outer surface to form a latent image thereon;

a charging member disposed proximate to the photoconductive member and including a first end portion and a second end portion, the charging member to charge the outer surface of the photoconductive member;

an imaging member to change the charge of selected portions of the outer surface of the photoconductive member to form the latent image thereon;

an adjustment assembly to move the first end portion of the charging member toward the photoconductive member to obtain a first electrical discharge event and to move the second end portion of the charging member toward the photoconductive member to obtain a second electrical discharge event; and an adjustment value identification module to identify a first adjustment value corresponding to a distance the first end portion moved toward the photoconductive member to obtain the first electrical discharge event and to identify a second adjustment value based on a distance the second end portion moved toward the photoconductive member to obtain the second electrical discharge event.

2. The image forming system according to claim 1, further comprising:

a position determination module to determine a set orientation position by determining a first distance and a second distance based on the first adjustment value and the second adjustment value; and wherein the adjustment assembly is configured to adjust an orientation of the charging member with respect to the photoconductive member to the set orientation position by moving the first end portion towards the photoconductive member by the first distance and moving the second end portion towards the photoconductive member by the second distance.

3. The image forming system according to claim 2, wherein the set orientation position includes an orientation of the charging member substantially parallel to the photoconductive member.

4. The image forming system according to claim 2, wherein the adjustment assembly further comprises:

a first adjustment unit including a first stepper motor and at least one first linkage member coupling the first stepper motor to the charging member to move the first end portion of the charging member toward and away from the photoconductive member; and a second adjustment unit including a second stepper motor and at least one second linkage member coupling the second stepper motor to the charging member to move the second end portion of the charging member toward and away from the photoconductive member.

5. The image forming system according to claim 4, wherein the first adjustment value corresponds to a number of steps moved by the first stepper motor based on the distance the first end portion moved toward the photoconductive member to obtain the first electrical discharge event and the second adjustment value corresponds to a number of steps moved by the second stepper motor based on the distance the second end portion moved toward the photoconductive member to obtain the second electrical discharge event.

6. The image forming system according to claim 5, wherein the first distance corresponds to a number of steps to be moved by the first stepper motor and the second distance corresponds to a number of steps to be moved by the second stepper motor to place the charging member in the set orientation position.

7. The image forming system according to claim 4, wherein the at least one first linkage member includes a first cam and the at least one second linkage member includes a second cam.

8. The image forming system according to claim 1, wherein the first electrical discharge event corresponds to conduction of electrical current from the first end portion of the charging member to the photoconductive member and the second electrical discharge event corresponds to conduction of electrical current from the second end portion of the charging member to the photoconductive member.

9. The image forming system according to claim 1, wherein the charging member further comprises a charge roller and the photoconductive member comprises a photo imaging cylinder.

10. The image forming system according to claim 1, further comprising:

a fluid applicator unit to apply fluid to the latent image on the outer surface of the photoconductive member to form an image; and an intermediate transfer member to receive the image from the photoconductive member and transfer the image to a substrate.

11. A method of calibrating an orientation of a charging member with respect to a photoconductive member in an image forming system, the method comprising:

moving a first end portion of a charging member with respect to a photoconductive member to obtain a first electrical discharge event corresponding to conduction of an electrical current from the charging member to the photoconductive member;

identifying a first adjustment value corresponding to a distance in which the first end portion moved toward the photoconductive member to obtain the first electrical discharge event;

moving a second end portion of the charging member with respect to the photoconductive member to obtain a second electrical discharge event corresponding to conduction of an electrical current from the charging member to the photoconductive member; and identifying a second adjustment value corresponding to a distance in which the second end portion moved toward the photoconductive member to obtain the second electrical discharge event.

12. The method according to claim 11, wherein the first adjustment value corresponds to a number of steps moved by a first stepper motor based on the distance the first end portion moved toward the photoconductive member to obtain the first electrical discharge event and the second adjustment value corresponds to a number of steps moved by a second stepper motor based on the distance the second end portion moved toward the photoconductive member to obtain the second electrical discharge event.

13. The method according to claim 11, further comprising:

determining a first distance to move the first end portion and a second distance to move the second end portion based on the first adjustment value and the second adjustment value to place the charging member in a substantially parallel position with respect to the photoconductive member.

14. The method according to claim 13, wherein the determining a first distance to move the first end portion and a second distance to move the second end portion further comprises:

determining a number of steps to be moved by a first stepper motor to move the first end portion and a number of steps to be moved by a second stepper motor to move the second end portion to place the charging member in the set orientation position.

15. The method according to claim 13, further comprising:

moving the first end portion by the first distance and the second end portion by the second distance to place the charging member in a substantially parallel position with respect to the photoconductive member.

16. The method according to claim 13, further comprising:

charging the charging member by a power supply in response to the charging member being placed in an initial position prior to the moving the first end portion of the charging member with respect to the photoconductive member to obtain the first electrical discharge event; and moving the first end portion of the charging member away from the photoconductive member to an initial position in response to obtaining the first electrical discharge event.

17. The method according to claim 13, further comprising:

moving the second end portion of the charging member away from the photoconductive member to an initial position in response to the second electrical discharge event.

18. The method according to claim 13, wherein the determining a first distance to move the first end portion and a second distance to move the second end portion further comprises:

calculating an offset value based on a difference between the first adjustment value and the second adjustment value; and applying the offset value to determine at least one of the first distance to move the first end portion and the second distance to move the second end portion.

19. The method according to claim 13, wherein the charging member further comprises a charge roller and the photoconductive member comprises a photo imaging cylinder.

20. A non-transitory computer-readable storage medium having computer executable instructions stored thereon for an image forming system to calibrate an orientation of a charging member with respect to a photoconductive member, the instructions are executable by a processor to:

move a first end portion of the charging member toward the photoconductive member by a first adjustment unit to obtain a first electrical discharge event corresponding to conduction of an electrical current from the charging member to the photoconductive member;

identify a first adjustment value by an adjustment value identification module corresponding to a distance in which the first end portion moved toward the photoconductive member to obtain the first electrical discharge event;

move a second end portion of the charging member toward the photoconductive member by a second adjustment unit to obtain a second electrical discharge event corresponding to conduction of electrical current from the charging member to the photoconductive member;

identify a second adjustment value by the adjustment value identification module corresponding to a distance in which the second end portion moved toward the photoconductive member to obtain the second electrical discharge event; and determine a first distance to move the first end portion toward the photoconductive member and a second distance to move the second end portion toward the photoconductive member by a position determination module based on the first adjustment value and the second adjustment value to place the charging member in a substantially parallel position with respect to the photoconductive member.

* * * * *